United States Patent [19]

Lathrop et al.

[11] 4,299,043

[45] Nov. 10, 1981

[54] SIGNAGE SYSTEM

[76] Inventors: Dan H. Lathrop, P.O. Box 821, Silverdale, Wash. 98383; Hendrick W. Haynes, P.O. Box 66152, Seattle, Wash. 98166

[21] Appl. No.: 114,106

[22] Filed: Jan. 17, 1980

[51] Int. Cl.[3] ..... G09F 15/00

[52] U.S. Cl. ..... 40/624; 40/601; 40/606; 40/611

[58] Field of Search ..... 40/624, 611, 563, 601, 40/618, 489, 606

[56] References Cited

U.S. PATENT DOCUMENTS

| | | | |
|---|---|---|---|
| 1,140,446 | 5/1915 | Cusack | 40/624 X |
| 2,211,015 | 8/1940 | Kay | 40/563 |
| 2,507,857 | 5/1950 | Johnson | 40/624 |
| 2,522,157 | 9/1950 | Bauers et al. | 40/601 |
| 2,591,494 | 4/1952 | Asachika | 40/601 |
| 2,775,833 | 1/1957 | Wishart | 40/624 |
| 2,775,834 | 1/1957 | Miller | 40/624 |
| 3,071,871 | 1/1963 | Ramseur | 40/624 X |
| 3,969,838 | 7/1976 | Moore | 40/611 X |
| 4,035,940 | 7/1977 | Mickey et al. | 40/611 |

*Primary Examiner*—Paul J. Hirsch
*Attorney, Agent, or Firm*—Harvey B. Jacobson

[57] ABSTRACT

A generally rectangular framework is constructed to hold a plurality of individual advertizing panels. The bottom and two sides of the frame are formed from channel members connected at their corners and designed to snugly but freely receive the plurality of panels. A pair of panel support members which are formed as parallel spaced walls extend between the tops of the side channel members and form the top of the framework. Each wall is connected to the ends of the legs of an angle iron member, the apexes of which are facing and spaced horizontally by approximately the width of the panels. The apexes are spaced vertically by an amount to allow the panels to be slid between them at an angular orientation so that the panels can be lifted in an angled position, pulled between the angle iron members, and rotated to a vertical position to be dropped between the sides of the channel member on the bottom of the framework. Each panel comprises a plurality of vertically spaced sections, each section slidably receiving one sign plate.

9 Claims, 5 Drawing Figures

SIGNAGE SYSTEM

BACKGROUND OF THE INVENTION

1. Field of the Invention

This invention relates to signage systems for the display of advertising material and especially to such systems of the fixed billboard type having removable elements.

2. Discussion of Related Art

Conventional billboards with removable panels have their panels attached in a normally fixed relation to a rigid backing frame, with each panel being attached separately by a conventional means, such as screws, nails, dowels, and/or pins. Removal of these panels requires much time and, because of the precision of fastener locations, requires special fabrication of board elements. Also, because signage systems are usually elevated 10 feet or higher above the ground, they customarily have a narrow walkway several feet wide affixed below the sign itself in front of each viewing area to accommodate the installation of advertising material and removal of same.

U.S. Pat. No. 2,775,834, issued Jan. 1, 1957, to Miller, shows a display device comprising a support member disposed at a site suitable for the display of advertising media. A sheet of paper-like material bearing advertising media on one side and adhesive on the other side is removably attached to the display device. U.S. Pat. No. 2,260,658, issued Oct. 28, 1941, to Connors, shows a signboard having an elongated base casing connected to a frame. A pair of top and bottom grooves extend along the frame and a plurality of advertising display panels fit loosely in the grooves side-by-side for sliding into different positions in the frame. The lower edges of the panels can be removed from the grooves by way of a gap provided in the bottom frame. U.S. Pat. No. 2,948,976, issued Aug. 16, 1960, to Miller, discloses a lightweight panel assembly for use with billboards. Each panel comprises a rigid framework having a plurality of vertical and horizontal cross frame members defining a lattice separated by a number of open areas. Lightweight metallic material is rigidly affixed to the framework and covers the open areas. Each of the frame members has an elongated continuous integral retaining lip formed thereon whereby the metallic material is positively supported on each side and held in a taut rigid condition.

SUMMARY OF THE INVENTION

One object of the present invention is to provide a low cost, easily fabricatable signage system.

Another object of the present invention is to provide a signage system whereby art work may be placed on panels in an environmentally controlled area, and transported to the signage site.

Still another object is to provide a signage system whereby the panels upon which the art work is placed are constructed of low cost materials and are easy to manufacture.

Yet a still further object of the present invention is to provide a signage system whereby the panels may be easily slid and secured into place with a minimal use of fasteners.

Even another object of the present invention is to provide a signage system whereby changes in temperature and humidity and its effects on the different materials of the signage system are compensated for.

A further object of the present invention is to provide a signage system whereby the panels are not freely removable by unauthorized persons.

Yet another object of the present invention is to provide a signage system whereby the panels may be removed by persons located above, away from, or below the system.

In accordance with the above objects, the present invention is constructed in the form of a rectangular framework supported by a pair of tubular support members. The lower portion of the framework is a channel-shaped member having a plurality of soft dowels disposed therein for supporting the weight of display panels which are disposed in the channel. The side frame members are also channel-shaped and one of the side frame members has a compression block in its base. The compression block can be moved laterally of the frame in order to apply pressure against and between a plurality of panels which are slidably received in the frame. In order to place the panels in the frame itself, the top member of the frame is equipped with a pulley system having a rope which can be connected to an eye disposed in the top of each panel. The panels are individually pulled up by the pulley and moved between a pair of facing angle members whose apexes are horizontally spaced by a width sufficient to receive the width of the panels. The apexes are vertically spaced by a distance sufficient to allow the panel to be moved therebetween at an angular orientation and swung to the vertical, then lowered into the lower channel member. A walkway is disposed along the top of the frame for providing access to the pulley mechanism. A weather guard is pivotally attached to the top frame member to protect the pulley and channel members from the elements. The weather guard can be locked to prevent access to the pulley by unauthorized persons.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
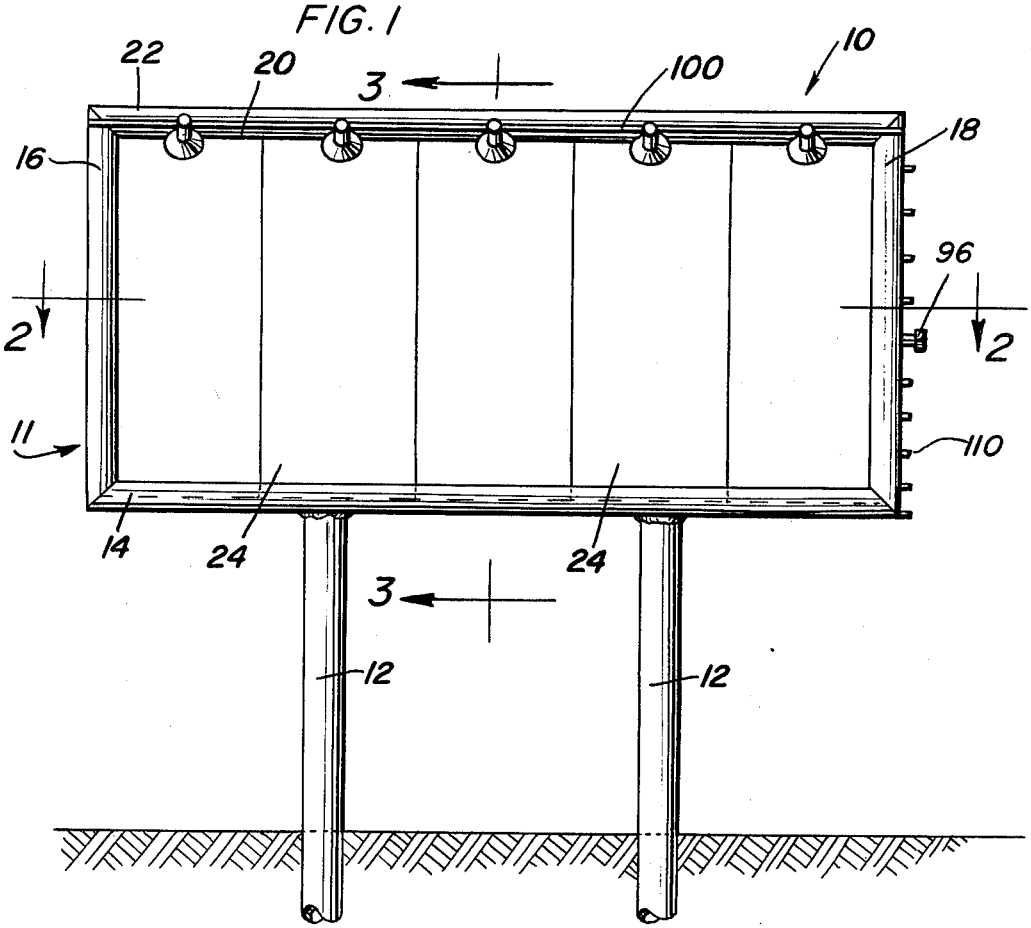
FIG. 1 is a front elevational view of the signage system of the present invention.

Now with reference to the drawings, a signage system incorporating the principles and concepts of the present invention and generally referred to by the reference numeral will be described in detail. In FIG. 1, it will be seen that the signage system 10 includes a display or billboard 11 which is supported by legs 12, such as large diameter tubes, ascending to and attached rigidly with a lower support channel 14. Lower support channel 14 can be made as a fabrication from plate material or stock, from tubes or preferably as an extruded form. Support channel 14 is connected to side channel 16 and side channel 18. Side channel 16 can be of a flat plate or square tube construction, while side channel 18 should of channel aluminum to allow the holding of compression block 94 and screws 96 to be contained therein (see FIG. 2). Side channel 16 and side channel 18 rise to panel support member 20 and are rigidly attached thereto. Panel support member 20 is covered by weather guard 22.

Figure 3:
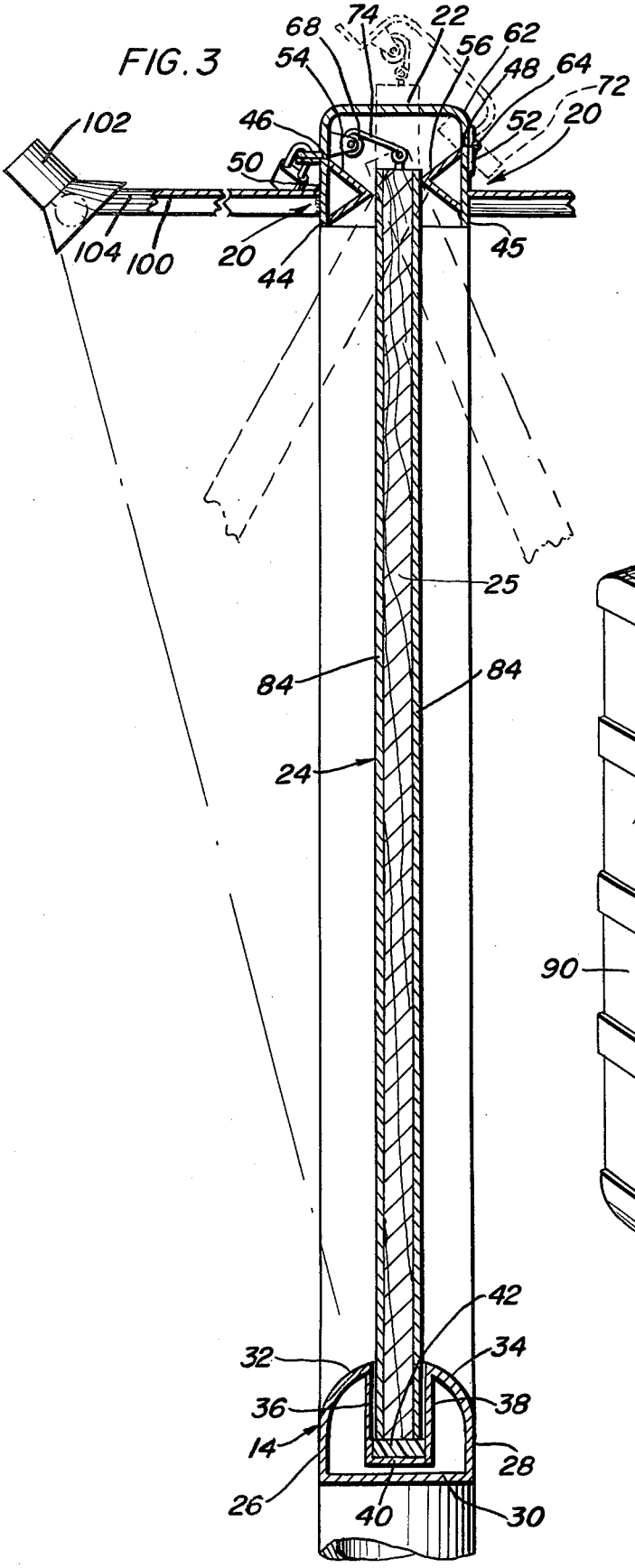
FIG. 3 is an end elevational sectional view taken substantially along a plane passing through section line 3—3 of FIG. 1.
Figure 4:
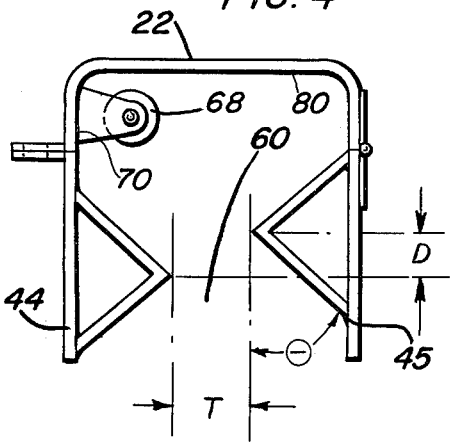
FIG. 4 is an enlarged view showing the top frame member of the signage system.

In FIG. 3, it will be seen that advertising panels 24 are mounted in support channel 14 with a loose (less than 0.030 inch but greater than 0.005 inch) yet secure fit. Channel 14 has vertical exterior sides 26 and 28, and a flat exterior bottom 30. The upper surface of channel 14 has a large smooth radius 32 and 34, such being provided to minimize the chance of damage to advertising panels 24 when they are raised and lowered into position. Channel 14 has inside depending walls 36 and 38, these dropping parallel to each other to channel bottom 40. Channel bottom 40 is covered with dowels 42 of soft synthetic material, such as polyethylene, although wood and some metal materials in a relation to reduce channel bottom friction may be used. Dowels 42 are aligned normally to the channel 14 longitudinal center line, and act as a means to reduce the sliding friction of the panels 24 when they are shifted back and forth into position. For this reason, depending walls 36 and 38 and channel bottom 40 must have a smooth finish to reduce panel damage possibilities.

Panels 24 are supported by the aforementioned panel support member 20. Panel support member 20 has outside upwardly directed walls 44 and 45. Walls 44 and 45 are connected to top flat surfaces 46 and 48, which are in turn adjoined to inside vertical depending walls 50 and 52. Panels 24 are securely held in place by angle iron members 54 and 56. Angle iron members 54 and 56 can be common 90° leg extrusions normally found in the art, although they can be tubes or bent sheet metal so long as the required panel clearances are maintained. Members 54 and 56 are securely joined to support member 20 by any known means, such as welding, bolting, etc., to form a rigid, unitized structure. Members 54 and 56 are not on-line with each other, but are (as a minimum) displaced vertically approximately by the relation: $D=T \sin \theta$, where $D$=vertical point to point displacement of members 54 and 56 from on-line, $\theta$=maximum extraction angle for panel. $T$=thickness of panel plus clearance allowance of from 0.005 inches to 0.030 inches.

Members 54 and 56 are spaced horizontally by the thickness of panel 24 plus clearance of from 0.005 inches to 0.030 inches. Thus, a single panel 24 may be placed into the billboard 10 by lifting panel 24 through slot 60 at an angle less than $\theta$, swinging panel 24 into a vertical position, then dropping panel 24 into support channel 14. To remove panel 24, the operation need only be reversed. Billboard 11 has support member 20 covered by a weather guard 22. Weather guard 22 is a large open channel (U-shaped in cross section) member hinged on one side (such as wall 45 to vertical surface 62 of weather guard 22). Hinge 64 is a full swivelling hinge to allow weather guard 22 to be swung fully open to pull panels 24 vertically for placement or removal through use of an attachment hook 66. A pulley 68 may be attached to the front inside face 70 of weather guard 22. If weather guard 22 is partly open and blocked securely to prevent closure by, for instance, a steel wedge or block 72, a line 74 may be passed over pulley 68 and attached to attachment hook 66 further facilitating placement and removal of panels 24. Of course, weather guard 22 can be locked in its closed position through use of locking mechanisms known in the art. The clearance between attachment hook 66 and inside top surface 80 of weather guard 22 is small such as to block the unauthorized removal of panels 24.

Figure 5:
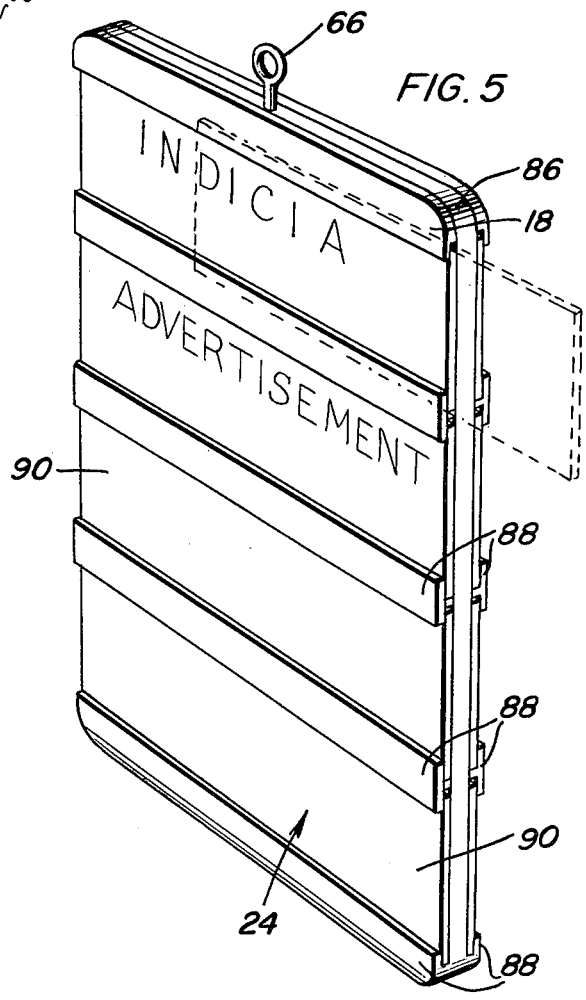
FIG. 5 is a perspective view of one panel of the present invention.

Panels 24 consist of a sheet of commonly sized plywood 25 sheathed on both sides of masonite surfaces 84 or other hard, non-warping coating. Of course, construction similar to making hollow core doors may be employed. The corners of the panel 24 have large radii shown generally at 86 on the order of 2 inches R or more for the purpose of allowing the free sliding of panels 24 in support channel 14. Furthermore, as seen in FIG. 5, on each side of panel 24 are a plurality of vertically spaced grooved support members 88 which extend laterally of the panels 24. Individual sign plates 90 are slidably received between opposing grooves of the members 88 and are held against the body of panels 24 in this manner. Of course, the panels 24 can either have totally smooth front and rear sides as shown in FIG. 3 for receiving one piece of advertising indicia or, each panel 24 can be equipped with members 88 to hold a plurality of advertising indicia with each individual advertisement being placed upon a single advertising plate 90.

Figure 2:
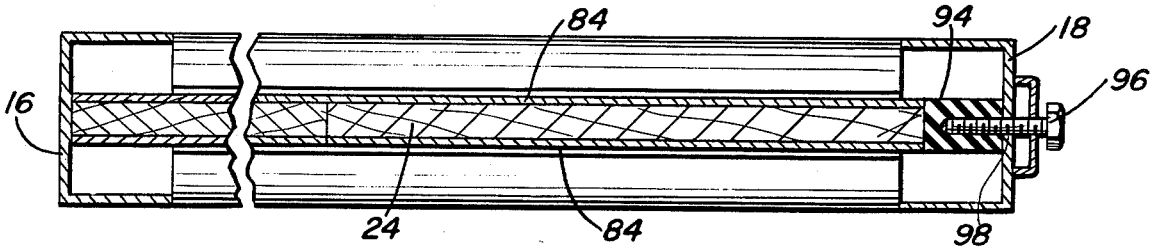
FIG. 2 is a top plan sectional view taken substantially along a plane passing through section line 2—2 of FIG. 1.

Panels 24 are placed within support member 20 and set into place into support channel 14. In FIG. 2, it can be seen that each panel 24 is to be slid to the far left edge of billboard 11 in channel 16 until the full viewing area contains all panels 24. A cumulative gap of $\frac{1}{2}$ inch will be left once all the panels 24 are in place. On the far right edge in channel 18, the compression block 94, which as afore-mentioned may be made out of a soft synthetic material, such as hard rubber or medium density polyethylene, is driven hard against the side of panels 24 by screws 96 twisted into tapped holes 98 of channel 18. The turning of screws 96 forces compression block 94 to advance away from tapped holes 98 and to push panels 24 tightly together. Compression block 94 is sufficiently thick and resilient to allow temperature and humidity flexing without damage to the panels 24. To remove panels 24, screws 96 must be advanced out of tapped holes 98 to give the panels room to move so as to be extracted.

Of course, a walkway 100 can be mounted above billboard 11 to permit a single service attendant to open weather guard 22 and, by attaching a rope to attachment hook 66, to pull vertically on panels 24 and lower them out of support channel 14. The walkway 100 is preferably made out of a low density expanded metal, such as aluminum, and is mounted on support tubes 104. On the end of support tubes 104 is mounted lights 102 directed at panels 24. Thus, during daylight, the sun is free to shine through walkway 100 and onto panels 24. When darkness surrounds billboard 11, lights 102 are turned on to illuminate the panels 24. A plurality of climbing rungs 110 are connected to the frame member 18 to allow access to screw 96 and walkway 100.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A sign system utilizing removable signs for displaying advertising and other indicia, said system comprising:

at least one removable sign on which said advertising and said other indicia may be selectively positioned; and frame support means for facilitating a supporting of said at least one removable sign in a displaying manner, said frame support means including top support means and bottom support means cooperatively operable to support said at least one removable sign in said displaying manner, said top support means including first and second horizontally extending support braces, said first and second horizontally extending support braces being respectively positioned proximate to opposite side surfaces of said at least one removable sign and each being engageable with said at least one removable sign along a surface of contact defined by a line, such respective surface contact lines each being created by respective pairs of surfaces defined by non-parallelly aligned planes on said respective first and second support braces, said respective surface contact lines associated with said first and second support braces being substantially parallely aligned and being vertically displaced from one another so as to define an angular opening therebetween which facilitates a movement of said at least one removable sign into an interior portion of said top support means when said at least one sign is angulated so as to substantially move a first plane defined by its indicia display surface towards an orthogonal relationship with a second plane having said respective surface contact lines substantially contained therein.

2. The sign system as defined in claim 1, wherein said top support means further includes suspension means for supporting said at least one removable sign, said suspension means being fixedly secured to said top support means and being selectively engageable with a hook means positioned on a topmost portion of said at least one removable sign.

3. The sign system as defined in claim 2, and further wherein said bottom support means includes a trough into which a bottommost edge of said at least one removable sign may be positioned to facilitate said supporting thereof.

4. The sign system as defined in claim 3, and further including compression block means for providing additional support to said at least one removable sign, said compression block means being selectively engageable with a side edge of said at least one removable sign to effectively force an opposite side edge of said at least one removable sign into supporting abutment with said frame support means.

5. The sign system as defined in claim 4, and further including resilient dowel support means positioned on a bottommost portion of said trough, said resilient dowel support means being operable to support said at least one removable sign while minimizing a danger of damage to said at least one removable sign during an insertion of said sign into said trough.

6. The sign system as defined in claim 5, and further including weather guard means hingedly connected to said top support means, said weather guard means being selectively hingedly movable to permit access to said suspension means associated with said frame support means and said hook means associated with said at least one removable sign.

7. The sign system as defined in claim 6, and further wherein said suspension means includes a pulley and line arrangement connectable to said hook means and being operable to raise and lower said at least one removable sign so as to facilitate said supporting thereof within said frame support means.

8. The sign system as defined in claim 7, and further wherein said bottom support means includes curved outer surfaces so as to further lessen a likelihood of damage to said at least one removable sign in the event that said at least one removable sign should inadvertently be brought into contact with said outer surfaces of said bottom support means.

9. The sign system as defined in claim 8, and further wherein said at least one removable sign is provided with grooved horizontally extending support braces being operable to retain a plurality of different display panels in fixed engagement with said at least one removable sign whereby said panels may be selectively interchanged and may each have various advertising and other indicia displayed thereon.

* * * * *